US010505285B2

(12) United States Patent
Kao et al.

(10) Patent No.: US 10,505,285 B2
(45) Date of Patent: Dec. 10, 2019

(54) MULTI-BAND ANTENNA ARRAY

(71) Applicant: MEDIATEK Inc., Hsin-Chu (TW)

(72) Inventors: Yeh-Chun Kao, Hsinchu (TW); Wun-Jian Lin, Hsinchu (TW); Chen-Fang Tai, Hsinchu (TW); Shao-Yu Huang, Hsinchu (TW); Shih-Huang Yeh, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 16/103,057

(22) Filed: Aug. 14, 2018

(65) Prior Publication Data

US 2019/0081414 A1 Mar. 14, 2019

Related U.S. Application Data

(60) Provisional application No. 62/558,376, filed on Sep. 14, 2017.

(51) Int. Cl.
*H01Q 1/24* (2006.01)
*H01Q 21/30* (2006.01)
(Continued)

(52) U.S. Cl.
CPC ..... *H01Q 21/30* (2013.01); *H01Q 5/15* (2015.01); *H01Q 5/28* (2015.01); *H01Q 5/378* (2015.01);
(Continued)

(58) Field of Classification Search
CPC ..... H01Q 1/242; H01Q 11/02; H01Q 21/28; H01Q 1/2208; H01Q 13/10; H01Q 5/335
(Continued)

(56) References Cited

U.S. PATENT DOCUMENTS 4,434,425 A 2/1984 Barbano et al.
6,211,841 B1 4/2001 Smith et al.
(Continued)

FOREIGN PATENT DOCUMENTS

FR 2863111 6/2005
JP 2013157920 8/2013

OTHER PUBLICATIONS

Office Action dated Jul. 29, 2019 in Taiwan application 10820713580, pp. 1-9.
(Continued)

*Primary Examiner* — Joseph J Lauture
(74) *Attorney, Agent, or Firm* — McClure, Qualey & Rodack, LLP

(57) ABSTRACT

A multi-band antenna array includes a plurality of first antennas for resonating at a first band, and a plurality of second antennas for resonating at a second band. A frequency of the second band is higher than a frequency of the first band. Locations of the plurality of first antennas project to a plurality of grid-one positions on a surface; locations of the plurality of second antennas project to a plurality of grid-two positions on the surface. Among the grid-one positions, a second grid-one position is nearest to a first grid-one position by a first distance along a first direction. Among the grid-two positions, a first grid-two position and a second grid-two position are closest two to the first grid-one position. The first and second grid-two positions are separated by a second distance along a second direction; and, the first direction and the second direction are nonparallel.

20 Claims, 16 Drawing Sheets

(51) Int. Cl.

| | |
|---|---|
| ***H01Q 5/378*** | (2015.01) |
| ***H01Q 5/28*** | (2015.01) |
| ***H01Q 5/15*** | (2015.01) |
| ***H01Q 21/06*** | (2006.01) |
| ***H01Q 21/28*** | (2006.01) |
| ***H01Q 25/00*** | (2006.01) |
| ***H01Q 5/42*** | (2015.01) |
| *H01Q 1/12* | (2006.01) |
| *H01Q 11/02* | (2006.01) |

(52) U.S. Cl.
CPC ..... *H01Q 5/42* (2015.01); *H01Q 21/064* (2013.01); *H01Q 21/065* (2013.01); *H01Q 21/28* (2013.01); *H01Q 25/001* (2013.01); *H01Q 1/1242* (2013.01); *H01Q 1/246* (2013.01); *H01Q 11/02* (2013.01)

(58) Field of Classification Search
USPC ..... 343/702, 700, 737, 850, 893, 895, 767, 343/861
See application file for complete search history.

(56) References Cited

U.S. PATENT DOCUMENTS

| | | | | |
|---|---|---|---|---|
| 2009/0224995 | A1* | 9/2009 | Puente ..... | H01Q 1/246 343/850 |
| 2010/0171675 | A1 | 7/2010 | Borja et al. | |
| 2016/0301144 | A1 | 10/2016 | Xiao et al. | |

OTHER PUBLICATIONS

EPO Search report dated Feb. 13, 2019 in EP application (No. 18190947.4-1205).

* cited by examiner

MULTI-BAND ANTENNA ARRAY

This application claims the benefit of U.S. Provisional application Ser. No. 62/558,376, filed Sep. 14, 2017, the subject matter of which is incorporated herein by reference.

FIELD OF THE INVENTION

The present invention relates to a multi-band antenna array, and more particularly, to a multi-band antenna array with antennas of different bands arranged adjacently along different directions for improving compactness.

BACKGROUND OF THE INVENTION

Antenna module is essential for devices which require wireless functionality, such as mobile phones which require mobile telecommunication. Modern advanced wireless functionality, such as 5G (fifth generation) mobile telecommunication, demands multi-band antenna module capable of signaling (transmitting and/or receiving) at multiple RF bands of different frequencies. In addition, limited form factor of wireless device constrains size of antenna module.

SUMMARY OF THE INVENTION

An objective of the invention is providing a multi-band antenna array (e.g., 100, 300*a*, 300*b*, 500*a*, 500*b*, 500*c*, 600*a*, 600*b*, 700, 800, 900*a* or 900*b* in FIG. 1, 3*a*, 3*b*, 5*a*, 5*b*, 5*c*, 6*a*, 6*b*, 7, 8, 9*a* or 9*b*) of improved compactness. The antenna array may include a plurality of first antennas (e.g., a1 to a4 in FIGS. 1, 2, 3*a*, 3*b*, 4*a*, 4*b*, 5*a*, 5*b*, 5*c*, 6*a*, 6*b*, 7 or 9*b*; a1 to a4 and a1*c* in FIGS. 9*a*; or, a1 to a9 in FIG. 8) for resonating at a first band (e.g., low-band), and a plurality of second antennas (e.g., b1 to b4 in FIG. 1, 2, 3*a*, 3*b*, 4*a*, 4*b*, 5*a*, 5*b*, 5*c*, 6*a*, 6*b*, 7 or 9*a*; or, b1 to b4 and b1*c* in FIG. 9*b*; or, b1 to b12 in FIG. 8) for resonating at a second band (e.g., low-band). A frequency of the second band may be higher than a frequency of the first band. Locations of the plurality of first antennas may respectively project to a plurality of grid-one positions (e.g., p1 to p4 in FIGS. 1, 2, 3*a*, 3*b*, 3*c*, 4*a*, 4*b*, 5*a*, 5*b*, 5*c*, 6*a*, 6*b*, 7 or 9*b*; or, p1 to p4 and p1*c* in FIGS. 9*a*; or, p1 to p9 in FIG. 8) on a surface (e.g., xy1 in FIG. 1, 2, 3*a*, 3*b*, 4*a*, 4*b*, 5*a*, 5*b*, 5*c*, 6*a*, 6*b*, 7, 8, 9*a* or 9*b*). Locations of the plurality of second antennas may respectively project to a plurality of grid-two positions (e.g., u1 to u4 in FIG. 1, 2, 3*a*, 3*b*, 3*c*, 4*a*, 4*b*, 5*a*, 5*b*, 5*c*, 6*a*, 6*b*, 7 or 9*a*; or, u1 to u12 in FIG. 8; or, u1 to u4 and u1*c* in FIG. 9*b*) on the surface (e.g., xy1). Among the plurality of grid-one positions, a second grid-one position (e.g., p2 in FIG. 1, 2, 3*a*, 3*b*, 3*c*, 4*a*, 4*b*, 5*a*, 5*b*, 5*c*, 6*a*, 6*b*, 7, 8 or 9*b*; or, p1*c* in FIG. 9*a*) of the plurality of grid-one position may be nearest to a first grid-one position (e.g., p1 in FIG. 1, 2, 3*a*, 3*b*, 3*c*, 4*a*, 4*b*, 5*a*, 5*b*, 5*c*, 6*a*, 6*b*, 7, 8, 9*a* or 9*b*) of the plurality of grid-one position by a first distance (e.g., d1 in FIG. 1, 3*a*, 3*b*, 7, 8 or 9*b*; or, d1*c* in FIG. 9*a*) along a first direction (e.g., v1 in FIG. 1, 3*a*, 3*b*, 5*a*, 7, 8 or 9*a*; or, v1*c* in FIG. 9*a*). Among the plurality of grid-two positions, a first grid-two position and a second grid-two position (e.g., u1 and u2 in FIG. 1, 2, 3*a*, 3*b*, 3*c*, 4*a*, 4*b*, 5*a*, 5*b*, 5*c*, 6*a*, 6*b*, 7, 8, 9*a* or 9*b*) of the plurality of grid-two positions are closest two to the first grid-one position. The first grid-two position and the second grid-two position may be separated by a second distance (e.g., d2 in FIG. 1, 3*a*, 3*b*, 7, 8, 9*a* or 9*b*) along a second direction (e.g., v2 in FIG. 1, 3*a*, 3*b*, 5*a*, 7, 8, 9*a* or 9*b*), According to the invention, the first direction and the second direction may be nonparallel.

In an embodiment (e.g., FIG. 1, 3*a*, 3*b*, 7, 8, 9*a* or 9*b*), the second distance (e.g., d2) may not be longer than the first distance (e.g., d1 or d1*c*), In an embodiment, (e.g., FIG. 1, 3*a*, 3*b*, 7, 8 or 9*b*), the second distance may be shorter than the first distance.

In an embodiment (e.g., FIG. 1), the second grid-two position (e.g., u2) may be on a first geometric line segment between the first grid-one position (e.g., p1) and the second grid-one position (e.g., p2). In an embodiment (e.g., FIG. 1), the second grid-two position may be at a midpoint of the first geometric line segment.

In an embodiment (e.g., FIG. 1), a ratio (e.g., d1/d2) dividing the first distance (e.g., d1) by the second distance (e.g., d2) may positively correlate to a ratio (e.g., f2/f1) dividing the frequency (e.g., f2) of the second band by the frequency (e.g., f1) of the first band. In an embodiment (e.g., FIG. 1), a ratio (e.g., d1/d2) dividing the first distance (e.g., d1) by the second distance (e.g., d2) may be substantially equal to a ratio (e.g., f2/f1) dividing the frequency (e.g., f2) of the second band by the frequency (e.g., f1) of the first band.

In an embodiment (e.g., FIG. 1), an angle between the first direction (e.g., v1) and the second direction (e.g., v2) may substantially equal 45 degrees.

In an embodiment (e.g., FIG. 1, 3*a*, 3*b*, 7, 8, 9*a* or 9*b*), among the plurality of grid-one positions, a third grid-one position (e.g., p4) of the plurality of grid-one positions may be second nearest to the first grid-one position (e.g., p1) by a third distance (e.g., d3) along a third direction (e.g., v3), and the third direction may be nonparallel to the first direction (e.g., v1 or v1*c*) and the second direction (e.g., v2).

In an embodiment (e.g., FIG. 1), the second grid-two position (e.g., u2) may be on a first geometric line segment between the first grid-one position (e.g., p1) and the second grid-one position (e.g., p2), and the first grid-two position (e.g., u1) is on a second geometric line segment between the first grid-one position (e.g., p1) and the third grid-one position (e.g., p3). In an embodiment (e.g., FIG. 1), the first grid-two position (e.g., u1) may be at a midpoint of the second geometric line segment.

In an embodiment (e.g., FIG. 1, 3*a*, 3*b*, 7, 8, 9*a* or 9*b*), the second direction (e.g., v2) may not be perpendicular to the first direction (e.g., v1 or v1*c*) and the third direction (e.g., v3).

In an embodiment (e.g., FIG. 1), the third direction (e.g., v3) may be substantially perpendicular to the first direction (e.g., v1). In an embodiment (e.g., FIG. 1), the third distance (e.g., d3) may be substantially equal to the first distance (e.g., d1).

In an embodiment (e.g., FIG. 4*a* or 4*b*), each of a subset (none, one, some or all) of the plurality of first antennas may include two first feed terminals, for two orthogonal polarization operation. In an embodiment, (e.g., FIG. 4*a* or 4*b*), each of a subset (none, one some or all) of the plurality of second antennas may include two second feed terminals, for two orthogonal polarization operation.

In an embodiment (e.g., FIG. 6*a* or 6*b*), the antenna array (e.g., 600*a* or 600*b*) may further include one or more parasitic elements (e.g., pa1 to pa8 or pb1 to pb8 in FIG. 6*a* or 6*b*).

In an embodiment (e.g., FIG. 7), the antenna array (e.g., 700) may further include a plurality of third antennas (e.g., c1 to c4), for resonating at a third band (e.g., higher high-band). A frequency of the third band may be higher than the frequency of the second band (e.g., high-band). Locations the plurality of third antennas may respectively project to a plurality of grid-three positions (e.g., k1 to k4)

on the surface (e.g., xy1). Among the plurality of grid-three positions (e.g., k1 to k4), a first grid-three position and a second grid-three position (e.g., k1 and k2) of the plurality of grid-three positions may be closest two to the second grid-two position (e.g., u2); and, the first grid-three position and the second grid-three position (e.g., k1 and k2) may be mutually separated by a fourth distance (e.g., d4) along a fourth direction (e.g., v4). The fourth direction (e.g., v4) and the second direction (e.g., v2) may be nonparallel.

In an embodiment (e.g., FIG. 7), the fourth distance (e.g., d4) may not be longer than the second distance (e.g., d2). In an embodiment (e.g., FIG. 7), the first grid-three position (e.g., k1) is on a geometric line segment between the first grid-two position (e.g., u1) and the second grid-two position (e.g., u2).

In an embodiment (e.g., FIG. 9*b*), among the plurality of grid-one positions, a third grid-one position (e.g., p4) and a fourth grid-one position (e.g., p3) of the plurality of grid-one positions may be second and third nearest to the first grid-one position (e.g., p1); and, a third grid-two position (e.g., u1*c*) of the plurality of grid-two positions is inside a geometric polygon (e.g., p1-p2-p3-p4) formed by vertices at the first grid-one position, the second grid-one position, the third grid-one position and the fourth grid-one position.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1:
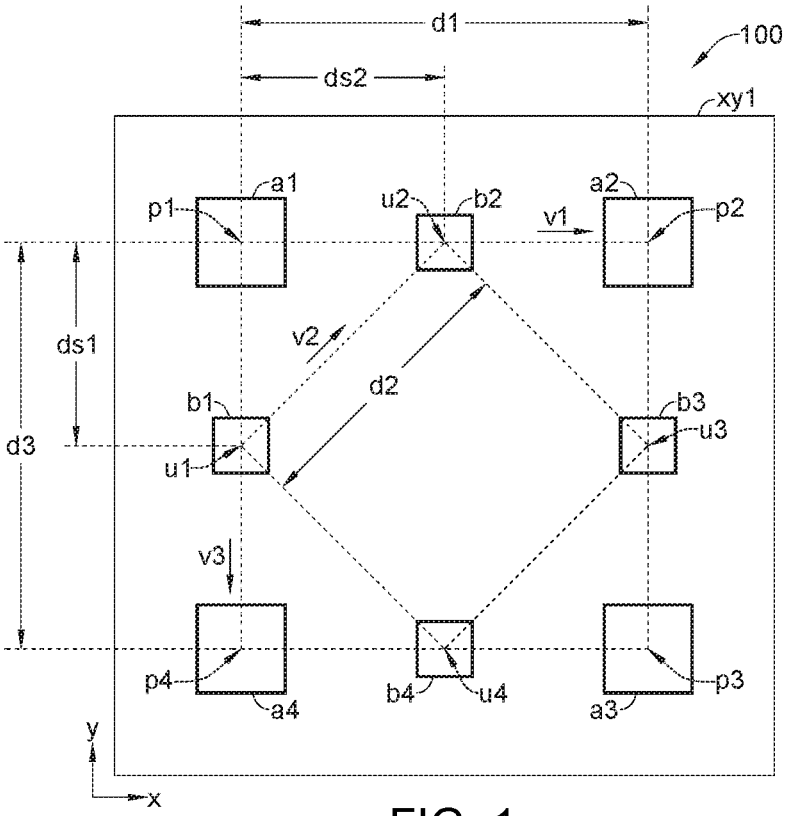
FIG. 1 illustrates a top view f an antenna array according to an embodiment of the invention.

Please refer to FIG. 1 illustrating a top view of an antenna array 100 according to an embodiment of the invention; the antenna array 100 may be a multi-band antenna array (antenna module). The antenna array 100 may include a plurality of low-band antennas, such as a1, a2, a3 and a4, for electromagnetic resonating at a low-band of a frequency f1. The antenna array 100 may also include a plurality of high-band antennas, such as b1, b2, b3 and b4, for electromagnetic resonating at a high-band of a frequency f2. The frequency f2 of the high-band may be higher than the frequency f1 of the low-band. The low-band antennas a1 to a4 may form a low-band subarray, and the high-band antennas b1 to b4 may form a high-band subarray.

Figure 2:
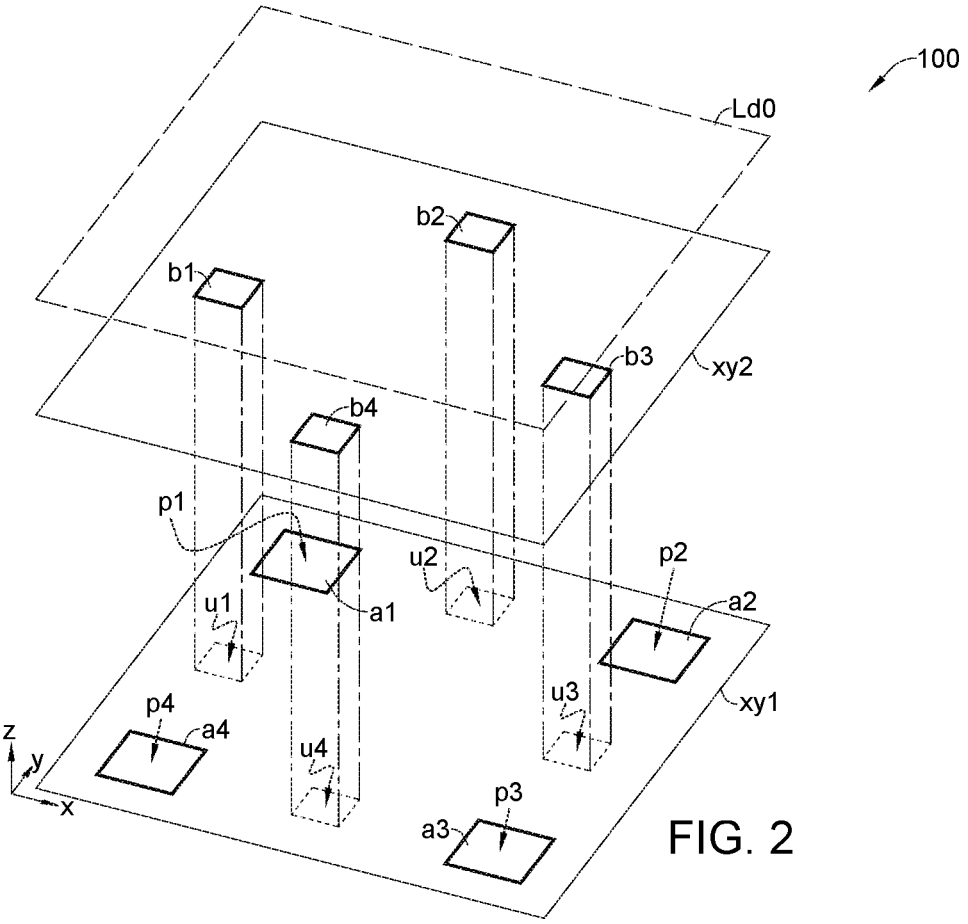
FIG. 2 illustrates a three-dimension view and a side view of the antenna array in FIG. 1 according to an embodiment of the invention.

The low-band antennas a1 to a4 and the high-band antennas b1 to b4 may be disposed near the same surface or near different surfaces; for example, as shown in FIG. 2, the antennas a1 to a4 may be disposed near a surface xy1 (e.g., an x-y plane), the antenna b1 to b4 may be disposed near a surface xy2, wherein the surfaces xy1 and xy2 may be the same surface, or be different surfaces. Locations of the low-band antennas a1 to a4 may project to positions p1 to p4 on the surface xy1. Locations of the high-band antennas b1 to b4 may project to positions u1 to u4 on the surface xy1. Each of the low-band antennas a1 to a4 may be a patch antenna, a PIFA (planar inverted-F antenna), a loop antenna, or a slot antenna, etc. Similarly, each of the high-band antennas b1 to b4 may be a patch antenna, a PIFA, a loop antenna, or a slot antenna, etc. Optionally, as shown in FIG. 2, the antenna array 100 may further include one or more antenna director layers, e.g., Ld0, parallel to the surfaces xy1 and xy2. The antenna director layer(s) may be insulated to the antennas a1 to a4 and b1 to b4, e.g., be separated from the antennas a1 to a4 and b1 to b4 by dielectric materials and/or air-filled space. The antenna director layer(s) Ld0 may be formed by metal(s) or material(s) of high dielectric constant(s), and may therefore enhance directional gain of the antenna array 100.

In general, a position of an antenna may refer to a geometric point, or a projection (to the surface xy1) of a geometric point, which has a predefined geometric relation with other geometric points of the antenna, and/or has a predefined geometric relation with geometric characteristics of the antenna. For example, a position of an antenna may refer to a geometric center (or a projection of the geometric center) of the antenna, or a midpoint (or a projection of the midpoint) on a given edge of the antenna, or a partition point (or a projection of the partition point) which divides a line segment between two given geometric points (e.g., vertices) of the antenna by a predefined ratio, etc.; or, a position of an antenna may refer to a location (or a projection of the location) of a feed terminal or a ground terminal of the antenna.

No matter whether the low-band antennas a1 to a4 and the high-band antennas b1 to b4 are on the same surface or on different surfaces (as shown in FIG. 2), in an embodiment, projected planar placement of the antennas a1 to a4 and b1 to b4 may be arranged according to FIG. 1. As shown in FIG.

1, among the positions p1 to p4 of the low-band antennas a1 to a4, the position p2 of the antenna a2 may be nearest to the position p1 of the antenna a1 by a distance d1 along a direction v1. That is, the distance d1 between the positions p1 and p2 may be shorter than or equal to a distance between the positions p1 and p3, and be shorter than or equal to a distance between the positions p1 and p4. The positions p1 to p4 of the low-band antennas a1 to a4 may be considered as grid-one positions indicative of a grid of the low-band subarray, and the direction v1 may indicate a direction of the grid of the low-band subarray; on the other hand, the positions u1 to u4 of the high-band antennas b1 to b4 may be considered as grid-two positions indicative of a grid of the high-band subarray.

Among the positions u1 to u4 of the high-band antennas b1 to b4, the positions u1 and u2 may be the closest two to the position p1 of the low-band antenna a1; i.e., for the position p1, one of the positions u1 and u2 may be the most proximate one of the positions u1 to u4, and the other one of the positions u1 and u2 may be the second most proximate one of the positions u1 to u4. That is, a distance ds1 between the positions p1 and u1 or a distance ds2 between the positions p1 and u2 may be shorter than or equal to a distance between the positions p1 and u3, and be shorter than or equal to a distance between the positions p1 and u4.

The two positions u1 and u2 closest to the position p1 may be mutually separated by a distance d2 along a direction v2. The direction v2 may indicate a direction of the grid of the high-band subarray. According to the invention, the direction v1 pointing from the positions p1 to p2 and the direction v2 pointing from the positions u1 to u2 may be arranged to be nonparallel. For example, as shown in FIG. 1, an angle between the direction v1 and the direction v2 may substantially equal 45 degrees. By arranging the directions v1 and v2 to be nonparallel, the high-band subarray formed by the high-band antennas b1 to b4 may be integrated among the low-band subarray formed by the low-band antennas a1 to a4, so as to improve compactness of the multi-band antenna array 100.

In an embodiment, the distance d2 between the positions u1 and u2 may be shorter than (or equal to) the distance d1 between the positions p1 and p2. For better radiation pattern of the high-band subarray, in an embodiment, the distance d2 may be set shorter than or equal to a half of a wavelength of the high-band. Similarly, for better radiation pattern of the low-band subarray, in an embodiment, the distance d1 may be set shorter than or equal to a half of a wavelength of the low-band. While a wavelength of a band is proportional to a reciprocal of a frequency of the band, the wavelength of the high-band is shorter than the wavelength of the low-band; thus, by setting the distance d2 shorter than (or equal to) the distance d1, both the low-band subarray and the high-band subarray may benefit from better radiation patterns.

In an embodiment, a distance ratio d1/d2 dividing the distance d1 by the distance d2 may positively correlate to a frequency ratio f2/f1 dividing the frequency f2 of the high-band by the frequency f1 of the low-band; that is, if the ratio f2/f1 is larger due to implementation demands, the ratio d1/d2 may be designed to be larger. In an embodiment, the distance ratio d1/d2 may be substantially equal to the frequency ratio f2/f1. For example, in an embodiment, the frequencies f1 and f2 may respectively be 28 GHz and 39 GHz, the ration f2/f1 may therefore approximately be 1.4, and the distance d2 may be set substantially equal to d1/1.4, or approximately 0.7*d1.

Among the positions p1 to p4 of the low-band antennas a1 to a4, while the position p2 may be the nearest to the position p1, the position p4 may be second nearest to the position p1 by a distance d3 along a direction v3; i.e., the distance d3 between the position p1 and p4 may be longer than or equal to the distance d1 between the positions p1 and p2, but be shorter than or equal to the distance between the positions p1 and p3. In an embodiment, the direction v3 may be arranged to be nonparallel to the directions v1 and v2. For example, as shown in FIG. 1, in an embodiment, the direction v3 may be substantially perpendicular to the direction v1 In an embodiment, the distance d2 may be shorter than or equal to the distance d3.

In an embodiment, as shown in FIG. 1, the position u2 may be placed on a geometric line segment p1-p2 between the positions p1 and p2. For example, in an embodiment, the position u2 may be placed at a midpoint of the line segment p1-p2, such that the distance ds2 between the positions p1 and u2 may substantially equal to a half of the distance d1. In a different embodiment, the position u2 may be placed on the line segment p1-p2, but at a point other than the midpoint of the line segment p1-p2, such that the distance ds2 may differ from a half of the distance d1. In yet another embodiment, the position u2 may not be placed on the line segment p1-p2.

In an embodiment, the position u1 may be placed on a geometric line segment p1-p4 between the positions p1 and p4. For example, in an embodiment, the position u1 may be placed at a midpoint of the line segment p1-p4, such that the distance ds1 between the positions p1 and u1 may substantially equal to a half of the distance d3. In a different embodiment, the position u1 may be placed on the line segment p1-p4, but at a point different from the midpoint of the line segment p1-p4, such that the distance ds1 may differ from a half of the distance d3. In yet another embodiment, the position u1 may not be on the line segment p1-p4.

Regarding the position p3 of the low-band antenna a3, a direction from the positions p4 to p3 may be set parallel or nonparallel to the direction v1; and, a direction from the positions p2 to p3 may be set parallel or nonparallel to the direction v3. A distance between the positions p3 and p4 may be set substantially equal to, or different from, the distance d1; and, a distance between the positions p2 and p3 may be set substantially equal to, or different from, the distance d3. In an embodiment, among the positions p1 to p4 of the low-band antennas a1 to a4, the positions p4 and p2 may be the nearest and the second nearest to the position p3.

Regarding the positions u3 and u4 of the high-band antennas b3 and b4, in an embodiment, a direction from the positions u1 to u4 may be nonparallel to the directions v1, v2, and v3; for example, as shown in FIG. 1, the angle between the direction from the positions u1 to u4 and the direction v2 may be 90 degrees. The direction from the positions u1 to u4 may be parallel or nonparallel to a direction from the positions u2 to u3; and, a direction from the positions u4 to u3 may be parallel or nonparallel to the direction v2. In an embodiment, the position u4 may be placed on a geometric line segment p3-p4 between the positions p3 and p4; in a different embodiment, the position u4 may not be placed on the geometric line segment p3-p4. In an embodiment, the position u3 may be placed on a geometric line segment p2-p3 between the positions p2 and p3; in a different embodiment, the position u3 may not be placed on the geometric line segment p2-p3.

As shown in FIG. 1, in an embodiment for multi-band of frequencies f1=28 GHz and f2=39 GHz, the directions v1 and v3 may be perpendicular, the direction from positions p4 to p3 may be parallel to the direction v1, the direction from positions p2 to p3 may be parallel to the direction v3, the distances d1 and d3 may be set equal, and the positions u1, u2, u3 and u4 may respectively be placed at the midpoints of the line segments p1-p4, p1-p2, p2-p3 and p3-p4, so the positions p1 to p4 may form four vertices of a geometric square p1-p2-p3-p4, and the positions u1 to u4 may form four vertices of a geometric square u1-u2-u3-u4 inside the square p1-p2-p3-p4. Under such arrangement, the distance d2 may be equal to sqrt(ds1^2+ds2^2)=d1*sqrt(2)/2 (with sqrt( ) denoting a square root), or approximately 0.7*d1, such that the distance ratio d1/d2 will approximately match the desired frequency ratio f2/f1.

Figure 3A:
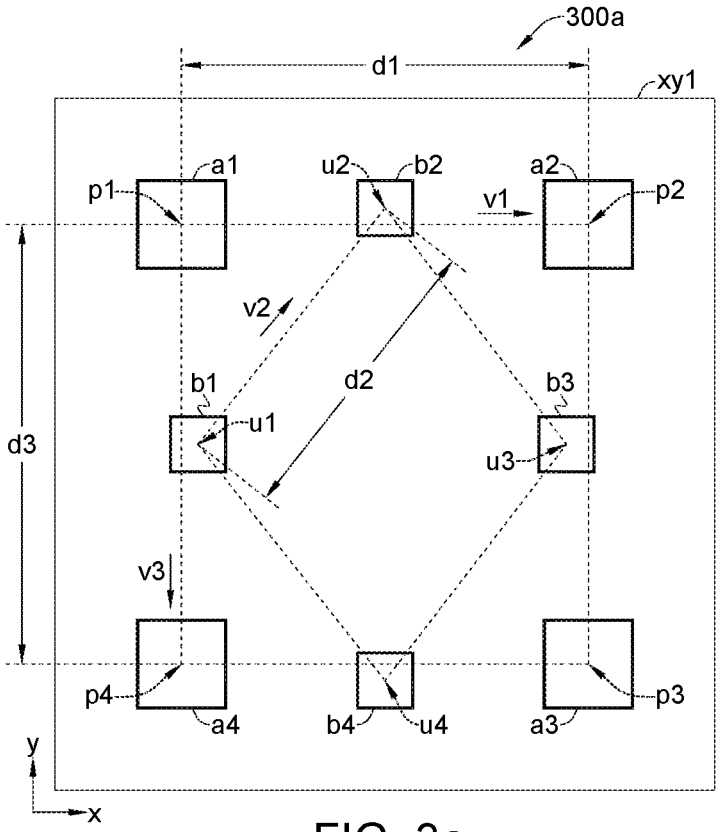
FIG. 3*a* illustrates a top view of an antenna array according to an embodiment of the invention.

Though the positions u1 to u4 are shown to be on the edges of the geometric polygonal p1-p2-p3-p4 in FIG. 1, the invention is not so limited. Please refer to FIG. 3*a* illustrating a top view of a multi-band antenna array 300*a*. Similar to the antenna array 100 in FIG. 1, the antenna array 300*a* in FIG. 3*a* may include low-band antennas a1 to a4 and high-band antennas b1 to b4; location of the antennas a1 to a4 may project to positions p1 to p4 on the surface xy1, and locations of the antennas b1 to b4 may project to positions u1 to u4 on the surface xy1. Among the positions p1 to p4, the positions p2 and p4 may be the nearest and the second nearest to the position p1, wherein the position p1 may be adjacent to the position p2 along a direction v1 by a distance d1, and be adjacent to the position p4 along a direction v3 by a distance d3 Among the positions u1 to u4, the positions u1 and u2 may be the closest two to the position p1, and the positions u1 and u2 may be separated by a distance d2 along a direction v2. The directions v2 may be nonparallel to the directions v1 and v3. As shown in FIG. 3*a*, in an embodiment, a subset (one, some or all) of the positions u1 to u4 may not be on any edge of the geometric polygonal p1-p2-p3-p4. For example, a first subset (none, one, some or all) of the positions u1 to u4 may be placed inside the polygonal p1-p2-p3-p4; and/or, a different second subset (none, one, some or all) of the positions u1 to u4 may be placed outside the polygonal p1-p2-p3-p4.

Figure 3B:
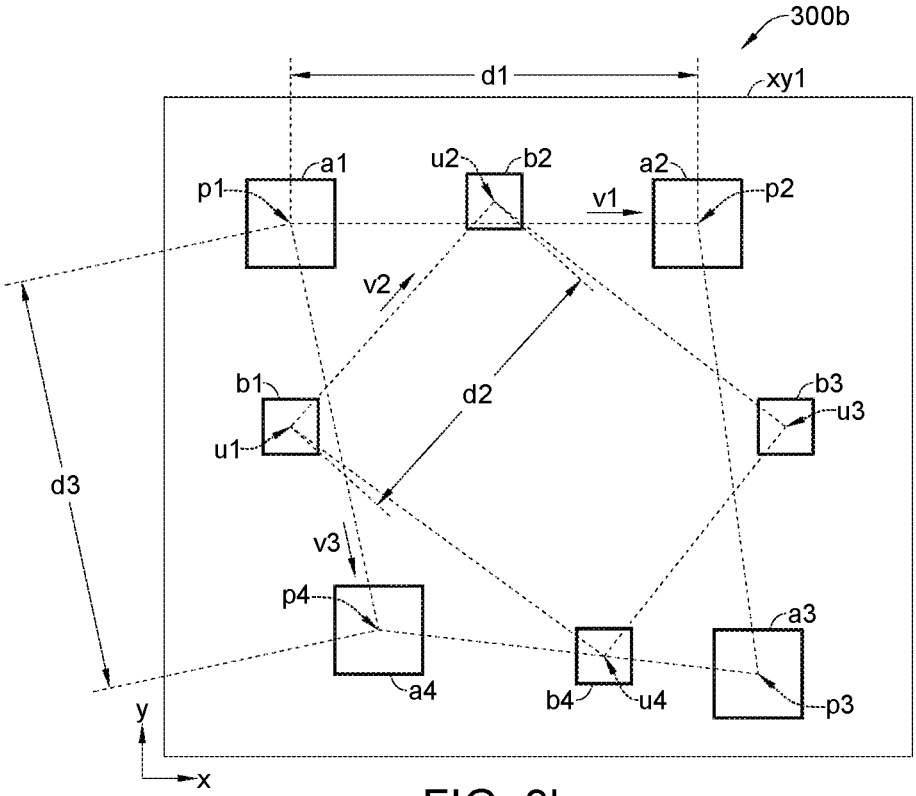
FIG. 3*b* illustrates a top view of an antenna array according to an embodiment of the invention.

Though the directions v1 and v3 are shown to be perpendicular in FIG. 1, the invention is not so limited. Please refer to FIG. 3*b* illustrating a top view of a multi-band antenna array 300*b*. Similar to the antenna array 100 and 300*a* in FIG. 1 and FIG. 3*a*, the antenna array 300*b* in FIG. 3*b* may include low-band antennas a1 to a4 and high-band antennas b1 to b4; locations of the antennas a1 to a4 may project to position p1 to p4 on the surface xy1, and locations of the antennas b1 to b4 may project to positions u1 to u4 on the surface xy1. Among the positions p1 to p4, the positions p2 and p4 may be the nearest and the second nearest to the position p1, wherein the position p1 may be adjacent to the position p2 along a direction v1 by a distance d1, and be adjacent to the position p4 along a direction v3 by a distance d3. Among the positions u1 to u4, the positions u1 and u2 may be the closest two to the position p1, and the positions u1 and u2 may be separated by a distance d2 along a direction v2. The directions v2 may be set nonparallel to the directions v1 and v3. As shown in FIG. 3*b*, in an embodiment, the directions v1 and v3 may not be perpendicular; i.e., an angle between the directions v1 and v3 may be less than or greater than 90 degrees.

Though in FIG. 1 the direction from the positions p4 to p3 is shown to be parallel to the direction v1, and the direction from positions p2 to p3 is shown to be parallel to the direction v3, the invention is not so limited. As shown in FIG. 3*b*, the direction from the positions p4 to p3 may be nonparallel to the direction v1; and/or, the direction from positions p2 to p3 may be nonparallel to the direction v3.

Figure 3C:
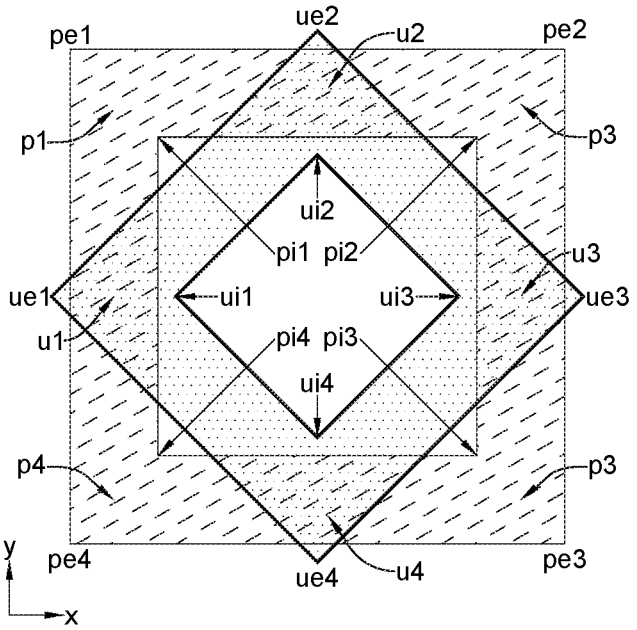
FIG. 3*c* illustrates a top view of possible antenna placement range according to an embodiment of the invention.

Along with FIG. 1 and FIGS. 3*a* to 3*b*, please refer to FIG. 3*c* illustrating a top view of possible placement range of the low-band antenna positions p1 to p4 and the high-band antenna positions u1 to u4. The positions u1 to u4 of the high-band antennas b1 to b4 may locate in a range bounded between an inner geometric polygonal ui1-ui2-ui3-ui4 and an outer geometric polygonal ue1-ue2-ue3-ue4. Without causing the antennas a1 to a4 to overlap projection of any one of the antennas b1 to b4, the positions p1 to p4 of the low-band antennas a1 to a4 may locate in a range bounded between an inner geometric polygonal pi1-pi2-pi3-pi4 and an outer geometric polygonal pe1-pe2-pe3-pe4. Each edge of the polygonal ui1-ui2-ui3-ui4 may be nonparallel to either edge of the polygonal pi1-pi2-pi3-pi4, and/or be nonparallel to either edge of the polygonal pe1-pe2-pe3-pe4. Each edge of the polygonal ue1-ue2-ue3-ue4 may be nonparallel to either edge of the polygonal pi1-pi2-pi3-pi4, and/or be nonparallel to either edge of the polygonal pe1-pe2-pe3-pe4. A geometric center of the polygonal pi1-pi2-pi3-pi4 may be inside the polygonal ui1-ui2-ui3-ui4; and/or, a geometric center of the polygonal pe1-pe2-pe3-pe4 may be inside the polygonal ui1-ui2-ui3-ui4.

Figure 4A:
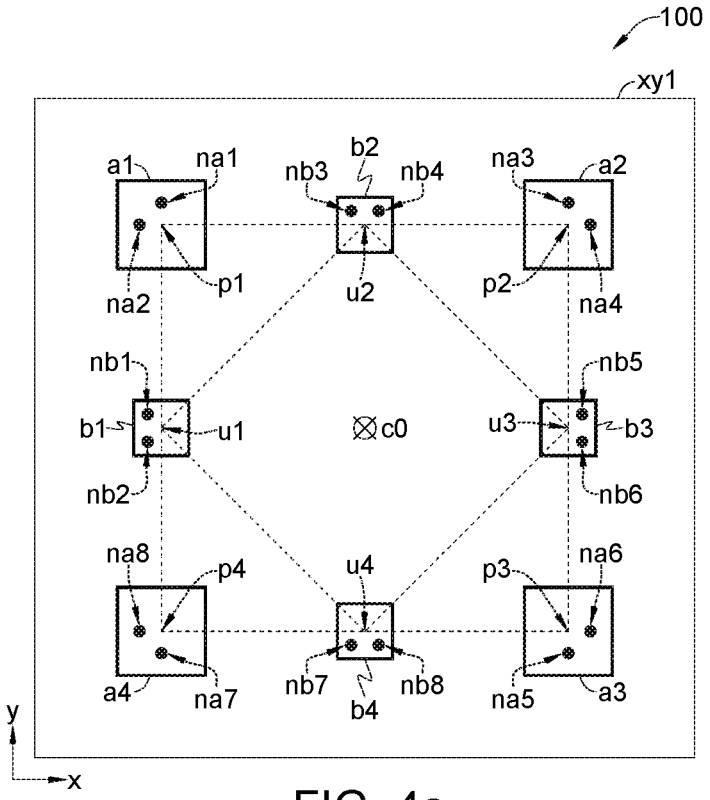
FIG. 4*a* illustrates a top view of feed terminal placement of the antenna array in FIG. 1 according to an embodiment of the invention.

In the antenna array 100 (FIG. 1), each of the low-band antennas a1 to a4 may include one or more feed terminals for relaying one or more low-band feed signals; for example, each of a subset (none, one, some or all) of the antennas a1 to a4 may include two feed terminals for two orthogonal polarization operation. Similarly, each of the high-band antennas b1 to b4 may include one or more second feed terminals for relaying one or more high-band feed signals; for example, each of a subset (none, one, some or all) of the antennas b1 to b4 may include two feed terminals for two orthogonal polarization operation. Along with FIG. 1, please refer to FIG. 4*a*; FIG. 4*a* illustrates a top view of feed terminal placement according to an embodiment of the invention. As shown in FIG. 4*a*, in the antenna array 100, the antenna al may include two feed terminals na1 and na2, the antenna a2 may include two feed terminals na3 and na4, the antenna a3 may include two feed terminals nay and na6, and the antenna a4 may include two feed terminals na1 and na8. Furthermore, the antenna b1 may include two feed terminals nb1 and nb2, the antenna b2 may include two feed terminals nb3 and nb4, the antenna b3 may include two feed terminals nb5 and nb6, and the antenna b4 may include two feed terminals nb7 and nb8.

As shown in FIG. 4*a*, in an embodiment, the feed terminals nb1 to nb8 of the high-band antennas b1 to b4 may be arranged outward from a geometric reference point c0; that is, within each high-band antenna, its two feed terminals may be placed at locations farther from the reference point c0. In another embodiment not shown, the feed terminals nb1 to nb8 of the high-band antennas b1 to b4 may be arranged toward the reference point c0. The reference point c0 may be a geometric point inside the polygonal p1-p2-p3-p4, and/or inside the polygonal u1-u2-u3-u4; for example, the reference point c0 may be a geometric center of the polygonal p1-p2-p3-p4 or the polygonal u1-u2-u3-u4. The feed terminals na1 to na8 of the low-band antennas a1 to a4 may also be arranged outward from the reference point c0.

Figure 4B:
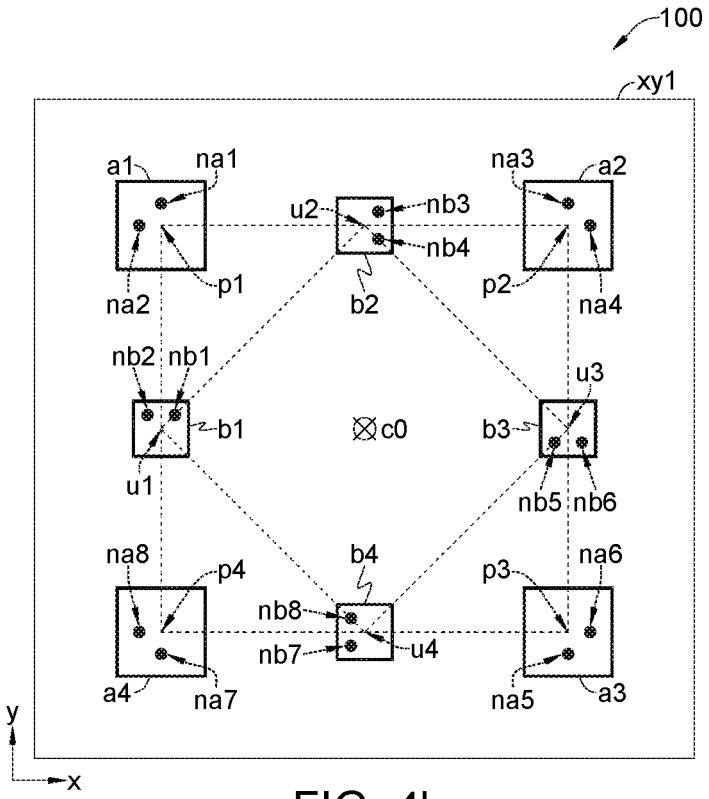
FIG. 4*b* illustrates a top view of feed terminal placement of the antenna array in FIG. 1 according to an embodiment of the invention.

Along with FIG. 1 and FIG. 4*a*, please refer to FIG. 4*b*; FIG. 4*b* illustrates a top view of feed terminal placement according to yet another embodiment of the invention. As shown in FIG. 4*b*, in an embodiment, some of the feed terminals nb1 to nb8 may be arranged toward the reference point c0, while others may be arranged outward from the reference point c0. For example, as shown in FIG. 4*b*, within the antenna b1, the feed terminals nb1 of the antenna b1 may be placed at a location closer to the reference point c0, while the other feed terminals nb2 of the antenna b1 may be placed at a location farther from the reference point c0. Though not shown in FIGS. 4*a* and 4*b*, it is understood that there may also be various embodiments for placing the feed terminals na1 to na8 of the low-band antennas a1 to a4, similar to placement of the feed terminals nb1 to nb8. Similar to FIGS. 4*a* and 4*b*, each of the antennas a1 to a4 and b1 to b4 in the antenna array 300*a* or 300*b* (FIG. 3*a* or 3*b*) may include one or more feed terminals, and there may be multiple different embodiments to arrange locations of the feed terminals.

Figure 5A:
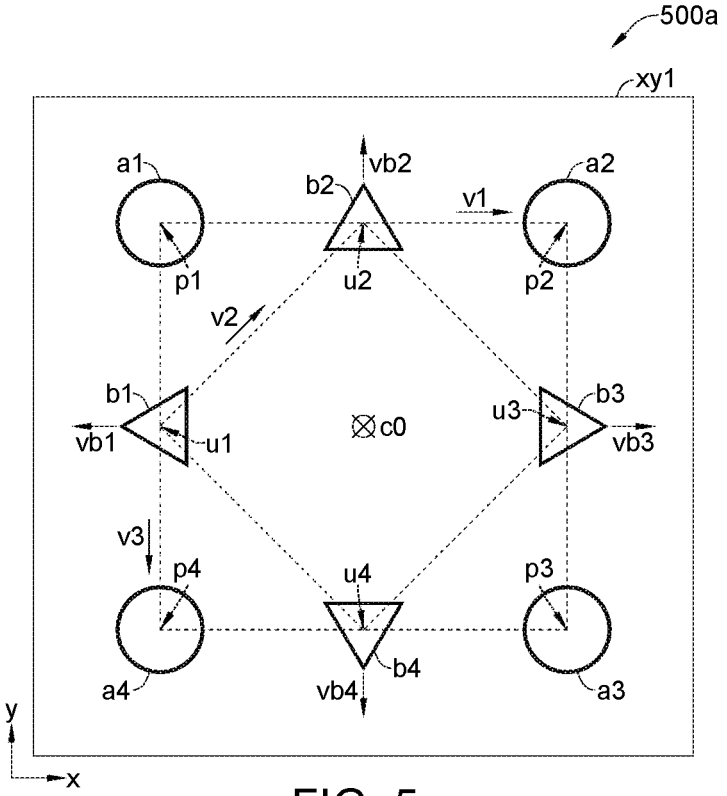
FIG. 5*a* illustrates a top view of an antenna array according to an embodiment of the invention.

Though shapes of the antennas a1 to a4 and b1 to b4 are shown to be rectangular in FIG. 1, the invention is not so limited. Along with FIG. 1, please refer to FIG. 5*a* illustrating a top view of an antenna array 500*a* according to an embodiment of the invention; the antenna array 500*a* in FIG. 5*a* may be achieved from the antenna array 100 in FIG. 1 by changing shapes of the antennas a1 to a4 and b1 to b4. As shown in FIG. 5*a*, the geometric shapes of the antennas b1 to b4 may respectively orient along reference directions vb1 to vb4; for example, the reference direction vb1 of the antenna b1 may be a geometric symmetry axis of its shape. In an embodiment, the reference direction vb1 to vb4 may point outward from (or toward) a geometric reference point c0. In an embodiment (not shown), the reference direction vb1 to vb4 may be parallel. In an embodiment (not shown), the reference directions vb1 and vb3 may be opposite, the reference directions vb2 and vb4 may be opposite, the reference direction vb1 may be parallel or nonparallel to a horizontal x-axis, and the reference direction vb2 may be parallel or nonparallel to a vertical y-axis. Though not shown in FIG. 5*a*, each of the low-band antenna a1 to a4 may also orient along its own reference direction, and there may be various embodiments to align the reference directions of the low-band antennas a1 to a4, similar to the high-band antennas b1 to b4.

Figure 5B:
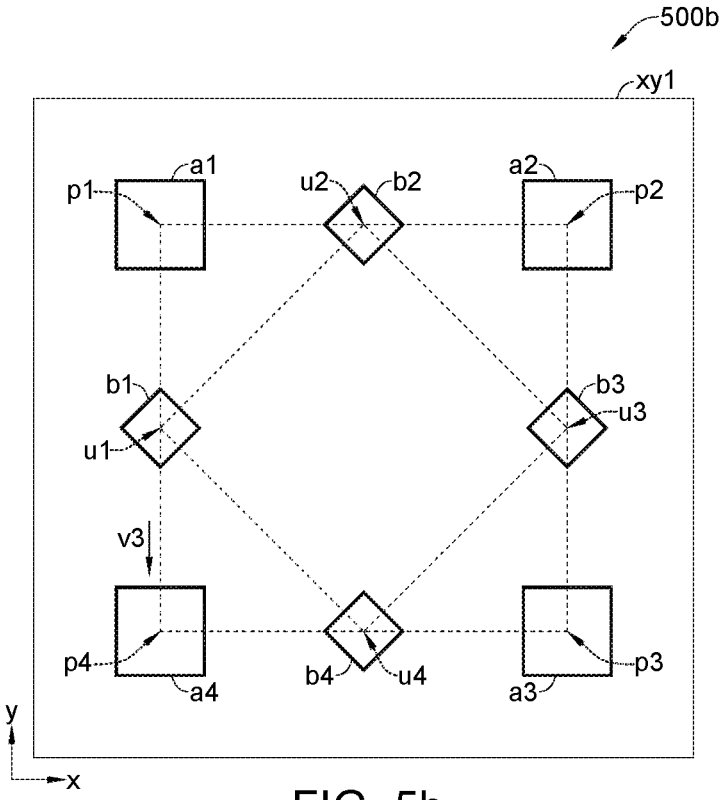
FIG. 5*b* illustrates a top view of an antenna array according to an embodiment of the invention.
Figure 5C:
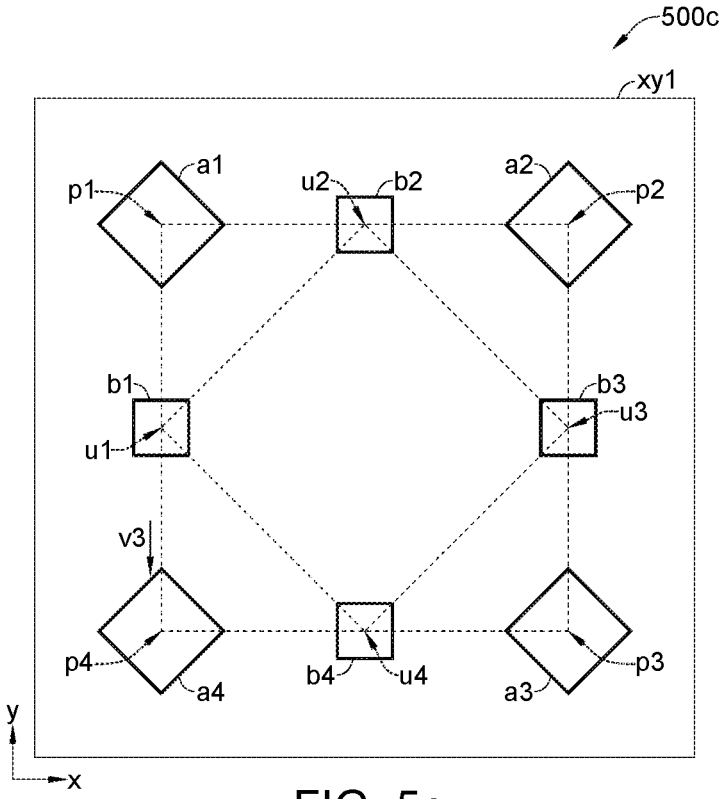
FIG. 5*c* illustrates a top view of an antenna array according to an embodiment of the invention.

Along with FIG. 1, please refer to FIG. 5*b* illustrating a top view of an antenna array 500*b* according to an embodiment of the invention; the antenna array 500*b* in FIG. 5*b* may be achieved from the antenna array 100 in FIG. 1 by changing orientations of the high-band antennas b1 to b4. Along with FIG. 1, please refer to FIG. 5*c* illustrating an antenna array 500*c* according to an embodiment of the invention; the antenna array 500*c* in FIG. 5*c* may be achieved from the antenna array 100 in FIG. 1 by changing orientations of the low-band antennas a1 to a4.

Figure 6A:
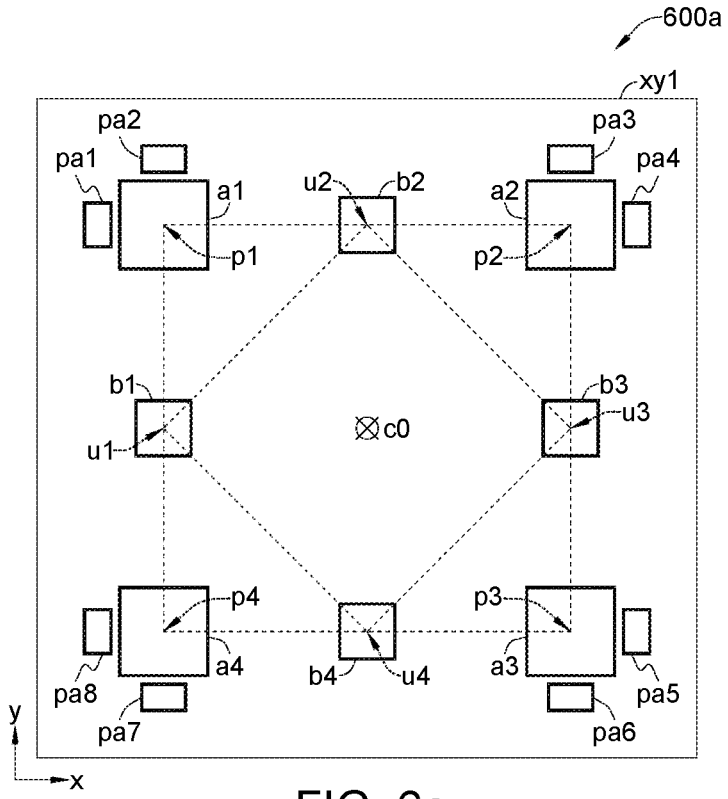
FIG. 6*a* illustrates a top view of an antenna array according to an embodiment of the invention.

Along with FIG. 1, please refer to FIG. 6*a* illustrating a top view of an antenna array 600*a* according to an embodiment of the invention; the antenna array 600*a* in FIG. 6*a* may be developed from the antenna array 100 in FIG. 1 by further including one or more parasitic elements, such as pa1 to pa8. The parasitic elements pa1 to pa8 and the antennas a1 to a4 may be disposed near the same surface xy1. The parasitic elements pa1 to pa8 may be formed by conductor (metal), and be insulated from the antennas a1 to a4 and b1 to b4. As shown in FIG. 6*a*, in an embodiment, the parasitic elements pa1 to pa8 may be placed near outer edges (with respect to a reference point c0) of the antennas a1 to a4. For example, the parasitic elements pa1 and pat may be placed near a top edge and a left edge of the antenna a1, since the top edge and the left edge are farther from the reference point c0 comparing to the other two edges of the antenna a1.

Figure 6B:
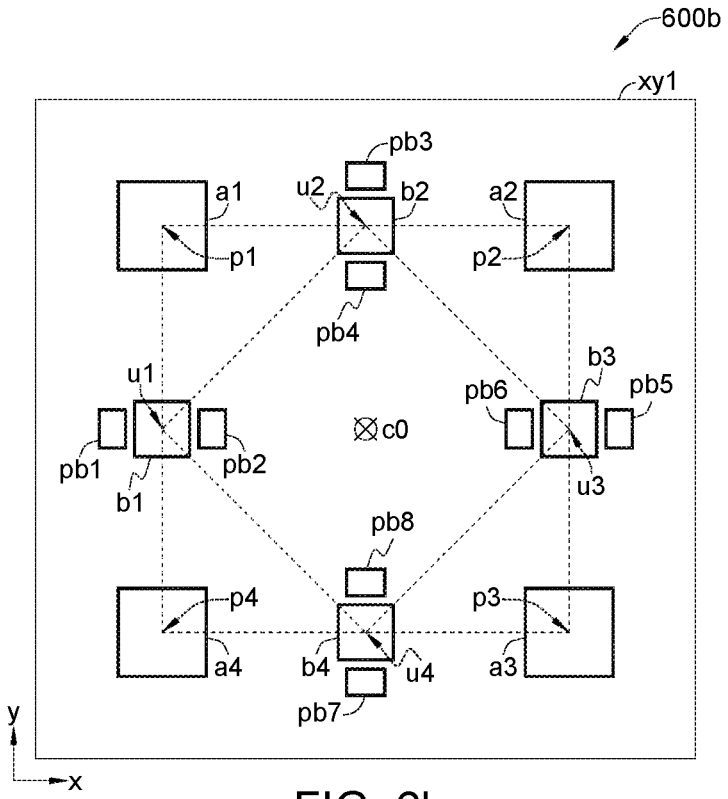
FIG. 6*b* illustrates a top view of an antenna array according to an embodiment of the invention.

Along with FIG. 1, please refer to FIG. 6*b* illustrating a top view of an antenna array 600*b* according to an embodiment of the invention; the antenna array 600*b* in FIG. 6*b* may be developed from the antenna array 100 in FIG. 1 by further including one or more parasitic elements, such as pb1 to pb8. The parasitic elements pb1 to pb8 and the antennas b1 to b4 may be disposed near the same surface (e.g., xy1 or xy2 in FIG. 2). The parasitic elements pb1 to pb8 may be formed by conductor (metal), and be insulated from the antennas a1 to a4 and b1 to b4. As shown in FIG. 6*b*, in an embodiment, the parasitic elements pb1, pb3, pb5 and pb7 may be placed near outer edges (with respect to a reference point c0) of the antennas b1 to b4, while the parasitic elements pb2, pb4, pb6 and pb6 may be placed near inner edges of the antennas b1 to b4. For example, among all edges of the antenna b1, its left edge and right edge are the farthest and the closest to the reference point c0, and the parasitic elements pb1 and pb2 may be respectively placed near the left edge and the right edge of the antenna b1.

Figure 7:
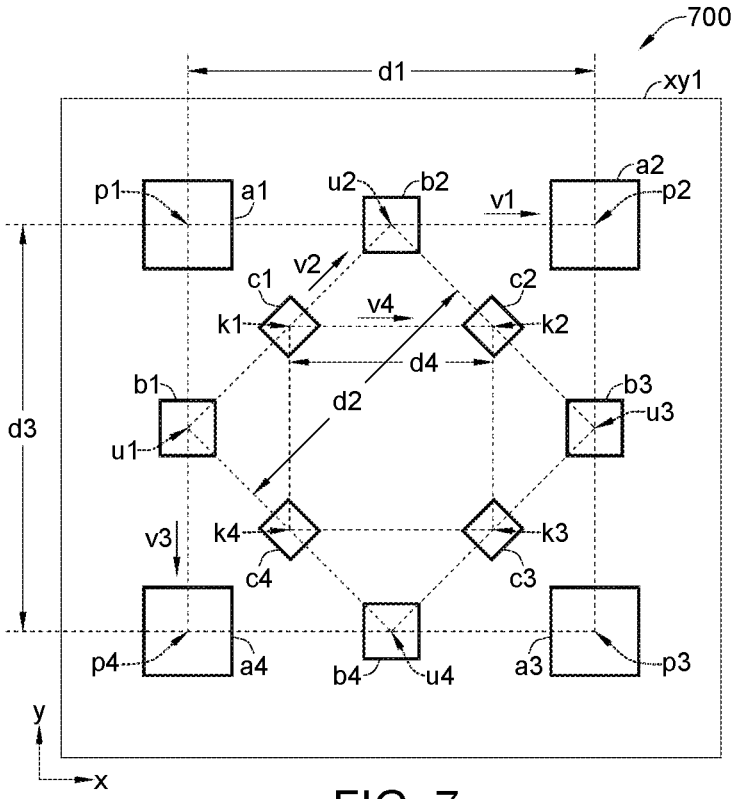
FIG. 7 illustrates a top view of an antenna array according to an embodiment of the invention.

Along with FIG. 1, please refer to FIG. 7 illustrating a top view of an antenna array 700 according to an embodiment of the invention; the antenna array 700 in FIG. 7 may be developed from the antenna array 100 in FIG. 1 by further including one or more higher high-band antennas, e.g., c1 to c4, for resonating at a higher high-band, wherein the a frequency f3 of the higher high-band may be higher than the frequency f2 of the high-band. The antennas c1 to c4 may be disposed near a surface (e.g., xy1 in FIG. 2) which the antennas a1 to a4 are disposed near, near a surface (e.g., xy2 in FIG. 2) which the antennas b1 to b4 are disposed near, or near a surface other than the surface(s) which the antennas a1 to a4 and b1 to b4 are disposed near. The antennas c1 to c4 may form a higher high-band subarray.

As shown in FIG. 7, locations the higher high-band antennas c1 to c4 may respectively project to positions k1 to k4 on the surface xy1, and the positions k1 to k4 may be considered as grid-three positions indicative of a grid of the higher high-band subarray. Among the positions k1 to k4 of the higher high-band antennas c1 to c4, the positions k1 and k2 may be the closest two to the position u2, and the positions k1 and k2 may be mutually separated by a distance d4 along a direction v4. According to an embodiment of the invention, the directions v4 and v2 may be nonparallel. For example, in an embodiment, an angle between the directions v2 and v4 may be set substantially equal to 45 degrees. In an embodiment, the distance d4 may not be longer than the distance d2; for example, the distance d4 may be shorter than the distance d2. In an embodiment, each of a subset (none, one, some or all) of the positions k1 to k4 may be on an edge of the geometric polygonal b1-b2-b3-b4; for example, in an embodiment, the position k1 may be on the geometric line segment between the positions u1 and u2. In an embodiment, a subset (none, one, some or all) of the positions k1 to k4 may not be on any edge of the geometric polygonal b1-b2-b3-b4.

As shown in FIG. 7, in an embodiment for multi-band frequencies f1=28 GHz, f2=39 GHz and f3=60 GHz, the directions v1 and v3 may be perpendicular; the direction from the positions p4 to p3 may be parallel to the direction v1, and the direction from the positions p2 to p3 may be parallel to the direction v3; a direction from the positions u4 to u3 may be parallel to the direction v2, a direction from the positions u2 to u3 may be parallel to a direction from the positions u1 to u4, and the direction v2 may be perpendicular to the direction from the positions u1 to u4; a direction from the positions k4 to k3 may be parallel to the direction v4, a direction from the positions k1 to k4 may be parallel to a direction from the positions k2 to k3, and the direction from the positions k1 to k4 may be perpendicular to the direction v4; the directions v1 and v4 may be parallel, and the direction from the positions k1 to k4 may be parallel to the direction v3; furthermore, the distances d1 and d3 may be set equal, a distance between the positions u1 and u4 may be equal to the distance d2, and a distance between the positions k1 and k4 may be equal to the distance d4; the positions u1, u2, u3 and u4 may respectively be placed at the midpoints of the line segments p1-p4, p1-p2, p2-p3 and p3-p4, and the positions k1, k2, k3 and k4 may respectively be placed at midpoints of geometric line segments u1-u2, u2-u3, u3-u4 and u4-u1, so the positions p1 to p4 may form four vertices of a geometric square p1-p2-p3-p4, the positions u1 to u4 may form four vertices of a geometric square u1-u2-u3-u4 inside the square p1-p2-p3-p4, and the positions k1 to k4 may form four vertices of a geometric square k1-k2-k3-k4 inside the geometric square u1-u2-u3-u4.

Similar to feed terminal arrangement of the low-band antennas a1 to a4 and the high-band antennas b1 to b4, each of the higher high-band antennas c1 to c4 in FIG. 7 may include one or more feed terminals (not shown in FIG. 7) for relaying one or more higher high-band feed signals.

Similar to FIGS. 5*a* to 5*c*, each of the antennas a1 to a4, b1 to b4 and c1 to c4 in the antenna array 700 may be of any shape oriented to any direction. Similar to FIG. 6*a* and/or FIG. 6*b*, the antenna array 700 may further include one or more parasitic elements (not shown) near the antennas a1 to a4, b1 to b4 and/or c1 to c4.

Figure 8:
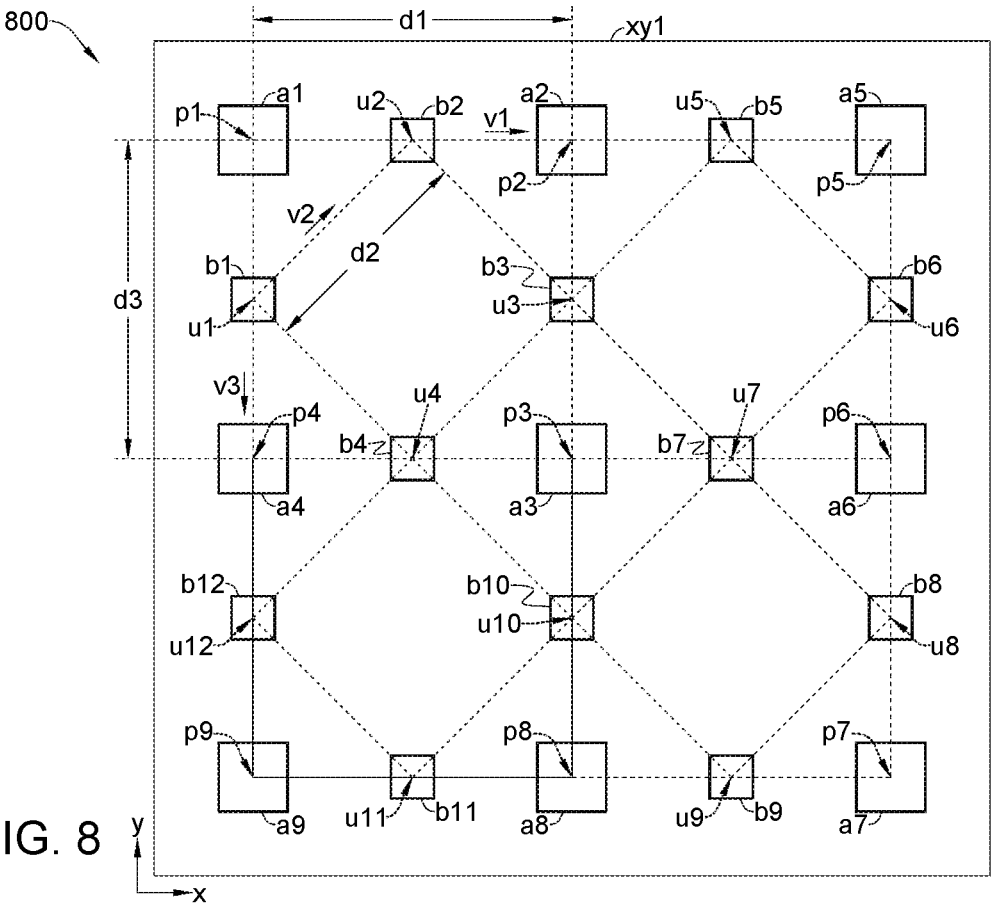
FIG. 8 illustrates a top view of an antenna array according to an embodiment of the invention.

Along with FIG. 1, please refer to FIG. 8 illustrating a top view of an antenna array 800 according to an embodiment of the invention; the antenna array 100 in FIG. 1 may be expanded to the antenna array 800 by further including more low-band antennas such as a5 to a9, and more high-band antennas such as b5 to b12. As the low-band antennas a1 to a4 may be disposed near the surface xy1, the additional low-band antennas a5 to a9 may also be disposed near the surface xy1, wherein locations of the additional low-band antennas a5 to a9 may respectively project to positions p5 to p9 at the surface xy1. As the high-band antennas b1 to b4 may be disposed near the surface xy2 (FIG. 2), the additional high-band antennas b5 to b12 may also be disposed near the surface xy2, wherein locations of the antennas b5 to b12 may project to positions u5 to u12 on the surface xy1. A placement pattern to place the antennas a1 to a4 and b1 to b4 may be spatially repeated to place the other antennas a5 to a9 and b5 to b12. For example, a geometric relation between the positions p2, p5, p6 and p3 of the antennas a2, a5, a6 and a3 may be the same as a geometric relation between the position p1 to p4 of the antennas a1 to a4; and, a geometric relation between the positions u3, u5, u6, u7 and p2, p5, p6 and p3 of the antennas b3, b5, b6, b7 and a2, a5, a6 and a3 may be the same as a geometric relation between the positions u1 to u4 and p1 to p4 of the antennas a1 to a4 and b1 to b4.

For example, regarding the positions p1 to p9 of the low-band antennas a1 to a9, while the positions p2 may be separated from the position p1 by the distance d1 along the direction v1, the positions p5 may be separated from the position p2 also by the distance d1 along the direction v1; while the positions p4 may be separated from the position p1 by the distance d3 along the direction v3, the positions p9 may be separated from the position p4 also by the distance d3 along the direction v3. On the other hand, regarding the positions u1 to u12 of the high-band antennas b1 to b12, a geometric triangle p2-u3-u5 formed by the positions p2, u3 and u5 may be congruent to a geometric triangle p1-u1-u2 formed by the positions p1, u1 and u2, with a direction from the positions u3 to u5 parallel to the direction v2; and, a geometric triangle u6-p6-u7 formed by the positions u6, p6 and u7 may be congruent to a geometric triangle u3-p3-u4 formed by the positions u3, p3 and u4, with a direction from the positions u6 to u7 parallel to a direction from positions u3 to u4.

Similar to the antennas a1 to a4, each of the antennas a5 to a9 may include one or more low-band feed terminals (not shown) for relaying one or more low-band feed signals; similar to the antennas b1 to b4, each of the antennas b5 to b12 may include one or more feed terminals (not shown) for relaying one or more high-band feed signals. As the two-band antenna array 100 in FIG. 1 may be augmented to the three-band antenna array 700 in FIG. 7 by including the higher high band antennas c1 to c4, the two-band antenna array 800 in FIG. 8 may also be augmented to a three-band antenna array (not shown) by further including higher high band antennas.

Similar to FIGS. 5*a* to 5*c*, the antennas a1 to a9 and b1 to b12 in the antenna array 800 may be of any shape oriented to any direction. Similar to FIG. 6*a* and/or FIG. 6*b*, the antenna array 800 may further include one or more parasitic elements (not shown); for example, the antenna array 800 may include: three parasitic elements near top edges of the antennas a1, a2 and a5; three parasitic elements near left edges of the antennas a1, a4 and a9; three parasitic elements near right edges of the antennas a5, a6 and a7; and/or, three parasitic elements near bottom edges of the antennas a7, a8 and a9.

Figure 9A:
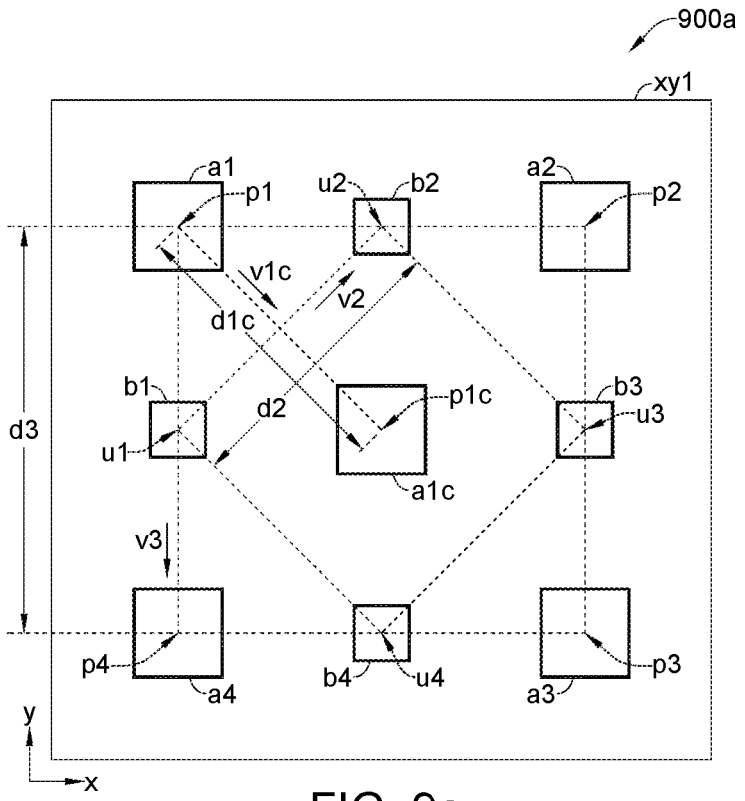
FIG. 9*a* illustrates a top view of an antenna array according to an embodiment of the invention.

Along with FIG. 1, please refer to FIG. 9*a* illustrating an antenna array 900*a* according to an embodiment of the invention; the antenna array 100 in FIG. 1 may be expanded to the antenna array 900*a* by further including an additional low-band antenna a1*c* for resonating at the low-band. The low-band antenna a1*c* may be disposed near the surface xy1; a location of the antenna a1*c* may project to a position p1*c* on the surface xy1, and the position p1*c* may be inside the geometric polygonal p1-p2-p3-p4. For example, the position p1*c* may be a geometric center of the geometric polygonal p1-p2-p3-p4 or u1-u2-u3-u4. Among the positions p1 to p4 and p1*c* of the low-band antennas a1 to a4 and a1*c*, the position p1*c* may be nearest to the position p1 by a distance d1*c* along a direction v1*c*. Among the positions u1 to u4 of the high-band antennas b1 to b4, the positions u1 and u2 may be the closest two to the position p1, and the positions u1 and u2 may be separated by the distance d2 along the direction v2. According to the invention, the directions v1*c* and v2 may be set nonparallel. In an embodiment, the distance d2 may not be longer than the distance d1*c*; for example, in an embodiment, the distance d2 may substantially equal to the distance d1*c*.

Similar to FIGS. 4*a* and 4*b*, in the antenna array 900*a*, each of the low-band antennas a1 to a4 and a1*c* may include one or more feed terminals; and, each of the high-band antennas b1 to b4 may include one or more feed terminals. Similar to FIGS. 5*a* to 5*c*, each of the antennas a1 to a4, a1*c* and bi to b4 in the antenna array 900*a* may be of any shape oriented to any direction. Similar to FIG. 6*a* and/or FIG. 6*b*, the antenna array 900*a* may further include one or more parasitic elements (not shown) near one or some of the antennas a1 to a4, a1*c* and b1 to b4.

Figure 9B:
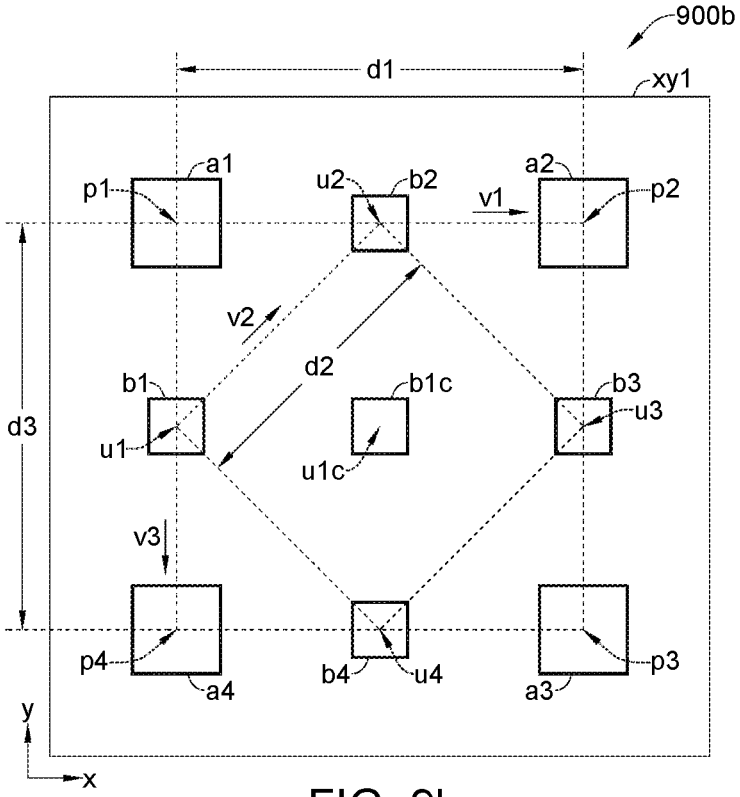
FIG. 9*b* illustrates a top view of an antenna array according to an embodiment of the invention.

Along with FIG. 1, please refer to FIG. 9*b* illustrating an antenna array 900*b* according to an embodiment of the invention; the antenna array 100 in FIG. 1 may be expanded to the antenna array 900*b* by further including an additional high-band antenna b1*c* for resonating at the high-band. As the high-band antennas b1 to b4 may be disposed near the surface xy2 (FIG. 2), the high-band antenna b1*c* may also be disposed near the surface xy2, and location of the antenna b1*c* may project to a position u1*c* on the surface xy1 The position u1*c* may be inside the geometric polygonal u1-u2-u3-u4. For example, the position u1*c* may be a geometric center of the geometric polygonal p1-p2-p3-p4 or u1-u2-u3-u4. Among the positions p1 to p4 of the low-band antennas a1 to a4, the position p2 of the antenna a2 may be nearest to the position p1 of the antenna a1 by the distance d1 along the direction v1. Among the positions u1 to u4 and u1*c* of the high-band antennas b1 to b4 and b1*c*, the positions u1 and u2 may still be closest two to the position p1, and the positions u1 and u2 may be separated by the distance d2 along the direction v2. According to the invention, the directions v1 and v2 may be set nonparallel.

Similar to FIGS. 4*a* and 4*b*, in the antenna array 900*b*, each of the low-band antennas a1 to a4 may include one or more feed terminals; and, each of the high-band antennas b1 to b4 and b1*c* may include one or more feed terminals. Similar to FIGS. 5*a* to 5*c*, each of the antennas a1 to a4, b1 to b4 and b1*c* in the antenna array 900*b* may be of any shape oriented to any direction. Similar to FIG. 6*a* and/or FIG. 6*b*, the antenna array 900*b* may further include one or more parasitic elements (not shown) near one or some of the antennas a1 to a4, b1 to b4 and b1*c*.

Similar to FIG. 7, the two-band antenna array 900*a* or 900*b* in FIG. 9*a* or 9*b* may be augmented to a three-band antenna array by further including higher high-band antennas. Similar to FIG. 8, the antenna array 900*a* or 900*b* in FIG. 9*a* or 9*b* may be expanded by further including more low-band antennas and high-band antennas which may be placed by repeating geometric placement pattern of the antenna array 900*a* or 900*b*.

Regarding the antenna array 300*a* or 300*b* in FIG. 3*a* or 3*b*, similar to FIGS. 5*a* to 5*c*, each of the antennas a1 to a4 and b1 to b4 in the antenna array 300*a* or 300*b* (FIG. 3*a* or 3*b*) may be of any shape oriented to any direction. Similar to FIG. 6*a* and/or FIG. 6*b*, the antenna array 300*a* or 300*b* in FIG. 3*a* or 3*b* may further include parasitic elements near the antennas a1 to a4 and/or b1 to b4. Similar to FIG. 7, the two-band antenna array 300*a* or 300*b* in FIG. 3*a* or 3*b* may be augmented to a three-band antenna array by further include one or more higher high-band antennas. Similar to FIG. 8, the antenna array 300*a* or 300*b* in FIG. 3*a* or 3*b* may be expanded by including more low-band antennas and/or high-band antennas. Similar to FIG. 9*a* or 9*b*, the antenna array 300*a* or 300*b* in FIG. 3*a* or 3*b* may be expanded by including an additional low-band antenna or high-band antenna at a position inside the geometric polygon u1-u2-u3-u4 and/or the geometric polygon p1-p2-p3-p4.

To sum up, by aligning grids of subarrays of different bands along different directions according to the invention, the subarrays of different bands may be nested into a constrained area, so as to improve compactness of multi-band antenna array.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A multi-band antenna array, comprising:

a plurality of first antennas for resonating at a first band; and a plurality of second antennas for resonating at a second band; wherein:

a frequency of the second band is higher than a frequency of the first band;

locations of the plurality of first antennas respectively project to a plurality of grid-one positions on a surface;

locations of the plurality of second antennas respectively project to a plurality of grid-two positions on the surface;

among the plurality of grid-one positions, a second grid-one position of the plurality of grid-one position is nearest to a first grid-one position of the plurality of grid-one position by a first distance along a first direction;

among the plurality of grid-two positions, a first grid-two position and a second grid-two position of the plurality of grid-two positions are closest two to the first grid-one position;

the first grid-two position and the second grid-two position are separated by a second distance along a second direction; and the first direction and the second direction are nonparallel.

2. The multi-band antenna array of claim 1, wherein the second distance is not longer than the first distance.

3. The multi-band antenna array of claim 1, wherein the second distance is shorter than the first distance.

4. The multi-band antenna array of claim 1, wherein:

the second grid-two position is on a first geometric line segment between the first grid-one position and the second grid-one position.

5. The multi-band antenna array of claim 4, wherein:

the second grid-two position is at a midpoint of the first geometric line segment.

6. The multi-band antenna array of claim 1, wherein a ratio dividing the first distance by the second distance positively correlates to a ratio dividing the frequency of the second band by the frequency of the first band.

7. The multi-band antenna array of claim 1, wherein a ratio dividing the first distance by the second distance is substantially equal to a ratio dividing the frequency of the second band by the frequency of the first band.

8. The multi-band antenna array of claim 1, wherein an angle between the first direction and the second direction substantially equals 45 degrees.

9. The multi-band antenna array of claim 1, wherein:

among the plurality of grid-one positions, a third grid-one position of the plurality of grid-one positions is second nearest to the first grid-one position by a third distance along a third direction; and the third direction is nonparallel to the first direction and the second direction.

10. The multi-band antenna array of claim 9, wherein:

the second grid-two position is on a first geometric line segment between the first grid-one position and the second grid-one position; and the first grid-two position is on a second geometric line segment between the first grid-one position and the third grid-one position.

11. The multi-band antenna array of claim 10, wherein:

the first grid-two position is at a midpoint of the second geometric line segment.

12. The multi-band antenna array of claim 9, wherein:

the third direction is substantially perpendicular to the first direction.

13. The multi-band antenna array of claim 9, wherein:

the third distance is substantially equal to the first distance.

14. The multi-band antenna array of claim 1, wherein:

each of a subset of the plurality of first antennas comprises two first feed terminals, for two orthogonal polarization operation.

15. The multi-band antenna array of claim 1, wherein:

each of a subset of the plurality of second antennas comprises two second feed terminals, for two orthogonal polarization operation.

16. The multi-band antenna array of claim 1 further comprises one or more parasitic elements.

17. The multi-band antenna array of claim 1 further comprises:

a plurality of third antennas, for resonating at a third band; wherein:

a frequency of the third band is higher than the frequency of the second band;

locations the plurality of third antennas respectively project to a plurality of grid-three positions on the surface;

among the plurality of grid-three positions, a first grid-three position and a second grid-three position of the plurality of grid-three positions are closest two to the second grid-two position;

the first grid-three position and the second grid-three position are mutually separated by a fourth distance along a fourth direction; and the fourth direction and the second direction are nonparallel.

18. The multi-band antenna array of claim 17, wherein the fourth distance is not longer than the second distance.

19. The multi-band antenna array of claim 18, wherein the first grid-three position is on a geometric line segment between the first grid-two position and the second grid-two position.

20. The multi-band antenna array of claim 1, wherein:

among the plurality of grid-one positions, a third grid-one position and a fourth grid-one position of the plurality of grid-one positions are second and third nearest to the first grid-one position; and a third grid-two position of the plurality of grid-two positions is inside a geometric polygon formed by vertices at the first grid-one position, the second grid-one position, the third grid-one position and the fourth grid-one position.

* * * * *